US007838750B2

(12) United States Patent
Steinberger

(10) Patent No.: US 7,838,750 B2
(45) Date of Patent: Nov. 23, 2010

(54) MUSICAL INSTRUMENT SLOPED NECK JOINT

(75) Inventor: Ned Steinberger, Nobleboro, ME (US)

(73) Assignee: Gibson Guitar Corp., Nashville, TN (US)

( * ) Notice: Subject to any disclaimer, the term of this patent is extended or adjusted under 35 U.S.C. 154(b) by 5 days.

(21) Appl. No.: 11/776,444

(22) Filed: Jul. 11, 2007

(65) Prior Publication Data

US 2008/0229897 A1 Sep. 25, 2008

Related U.S. Application Data

(60) Provisional application No. 60/896,413, filed on Mar. 22, 2007.

(51) Int. Cl.
*G10D 3/00* (2006.01)

(52) U.S. Cl. ..... 84/293

(58) Field of Classification Search ..... 84/293, 84/267, 290, 291; D17/20
See application file for complete search history.

(56) References Cited

U.S. PATENT DOCUMENTS

| | | | | |
|---|---|---|---|---|
| 2,793,556 | A | 5/1957 | Maccaferri | 84/267 |
| 2,795,988 | A | 6/1957 | Maccaferri | 84/293 |
| 3,302,507 | A | 2/1967 | Fender | 84/267 |
| 4,803,906 | A * | 2/1989 | Fender | 84/293 |
| 5,305,819 | A | 4/1994 | Boulanger et al. | 144/347 |
| 5,353,672 | A | 10/1994 | Stewart | 84/291 |
| 5,679,910 | A | 10/1997 | Steinberger et al. | 84/291 |
| 5,786,539 | A | 7/1998 | Steinberger | 84/293 |
| 5,886,272 | A * | 3/1999 | Regenberg | 84/293 |
| 6,028,255 | A * | 2/2000 | Myronyk | 84/293 |
| 6,265,648 | B1 | 7/2001 | Steinberger | 84/293 |
| 6,831,218 | B2 | 12/2004 | Steinberger | 84/293 |

OTHER PUBLICATIONS

International Search Report and Written Opinion from the International Search Authority (US) for International Application PCT/US2008/53848 dated Jun. 25, 2008.

* cited by examiner

*Primary Examiner*—Jianchun Qin
(74) *Attorney, Agent, or Firm*—Andrea Bates

(57) ABSTRACT

A joint between a neck and a body of a stringed musical instrument is described, wherein a neck receiving cavity in the body has a sloped major bearing surface. The sloped major bearing surface urges the neck laterally into a side surface of the neck receiving cavity as a connector pulls the neck into the neck receiving cavity. By urging the neck into a side surface of the neck receiving cavity, a second bearing surface is made in a different plane than the major bearing surface, which makes a more rigid joint between the body and the neck of the musical instrument.

20 Claims, 2 Drawing Sheets

MUSICAL INSTRUMENT SLOPED NECK JOINT

CROSS-REFERENCES TO RELATED APPLICATIONS

This application is a Nonprovisional application which claims benefit of U.S. patent application Ser. No. 60/896,413 filed Mar. 22, 2007, entitled "Musical Instrument Sloped Neck Joint" which is hereby incorporated by reference.

BACKGROUND OF THE INVENTION

1. Field of the Invention

The present invention relates generally to the neck joint in a stringed musical instrument such as a guitar. A guitar has two primary parts, including the body of the guitar and the neck of the guitar. The neck is attached to the body at the neck joint.

There are many techniques for connecting the neck with the body of the musical instrument. It is important that the neck is attached securely and rigidly, such that the neck does not move relative to the body.

2. Description of the Related Art

There are several ways of attaching a neck to a guitar body, and the techniques used have evolved over time. For example, U.S. Pat. No. 2,793,556 by MacCaferri uses a support bar within the body of the guitar. The neck is bolted to the support bar and then separate bolts connect the body of the guitar to the neck. The forces exerted by the neck and the strings are carried by the support bar instead of the body of the guitar. The support bar extends through the entire body of the guitar and terminates at the back end of the guitar.

Fender, in U.S. Pat. No. 3,302,507 describes an adjustable support bar that runs the length of the body of the guitar. The neck is joined to a neck receiving area by screws and is held in place by a stop or key member, which is a wood or metal dowel received in both the neck and neck receiving area of the body. The stop, combined with the support bar and the neck receiving area, prevent the pressure from the strings from distorting the body of the guitar.

Fender also discloses an electric guitar body with a standardized slot for receiving a guitar neck, in U.S. Pat. No. 4,803,906. The guitar neck has a standardized back end with the front or fret side being a variable size. Because the guitar neck has a standard sized back end, various guitar necks can be fixed to a single guitar body and the guitar neck can be changed to change the performance and appearance of the guitar without having to purchase an entirely new instrument.

Boulanger, et al. in U.S. Pat. No. 5,305,819 describes a neck with slightly angled sides such that the neck forms a wedge pointing away from the head of the neck. The neck receiving area in the body has parallel sides. There is a bearing pin with a cam, which is received in holes in the neck and the body. The bearing pin holes in the neck and the body are slightly off center, so that when the neck and the body are clamped together with the bearing pin received in the bearing pin holes, the neck is wedged and crushed into the neck receiving cavity. Notches are formed in the neck to accommodate glue to better secure the neck and the body together.

U.S. Pat. No. 5,786,539 by Steinberger describes three embodiments for pushing the neck into a side bearing surface of the neck receiving cavity in the body. The first embodiment is simply to angle the screws that hold the neck and the body together. The next embodiment includes an angled pressure piece set in the neck that engages a stop. The pressure piece is angled such that when the stop is pressed into the pressure piece the neck is pushed against the side of the neck receiving cavity. The stop is pressed into the pressure piece in a perpendicular line to the length of the neck. The third embodiment is similar to the second in that an angled pressure piece is pushed by a stop such that the neck is pushed into the side of the neck receiving cavity. However, in the third embodiment the stop is parallel to the length of the neck.

Another patent by Steinberger, U.S. Pat. No. 6,265,648, describes a pivot point for the neck with a spring urging the neck one way and an adjustment member mounted to move in a direction opposing the biasing force of the spring. The adjustment member presses on a pressure plate which is angled to urge the neck into a side surface. The invention also includes an intonation adjustment to adjust the distance between the bridge on the body of the guitar and the nut on the neck of the guitar. The intonation adjustment has an angled bearing member which also urges the neck into a side surface of the neck receiving cavity in the body of the guitar.

BRIEF SUMMARY OF THE INVENTION

The present invention comprises a stringed musical instrument having a body with a neck receiving cavity defined in the body. A neck of the stringed musical instrument is received and secured in the neck receiving cavity with threaded connectors. This creates a bolt neck joint between the guitar body and neck. The neck receiving cavity has a major bearing surface flanked by a major side surface and a cutout side surface, and a proximal section of a guitar neck is dimensioned to fit into the neck receiving cavity. The neck proximal section has a rear bearing surface between first and second surfaces. The rear bearing surface faces the major bearing surface, the first surface faces the major side surface, and the second surface faces the cutout side surface. Connectors are inserted into the neck through the instrument body and the major bearing surface.

The neck receiving cavity is sloped such that the major bearing surface slopes towards the major side surface opposite the guitar cutout. A cavity depth is defined as the distance from front of the guitar to the major bearing surface, and the slope of the major bearing surface results in the cavity depth being greater at the major side surface than at the cutout side surface. The neck is pulled directly down into the neck receiving cavity by the connectors, so the slope of the neck receiving cavity urges the neck first surface into the neck receiving cavity major side surface. This makes the major side surface of the neck receiving cavity a bearing surface, and provides greater rigidity for the joint between the guitar body and the neck.

One object of the present invention is to provide a more rigid bolt neck joint between a musical instrument body and neck.

Another object of the present invention is to provide two intersecting bearing surfaces in the neck joint between a musical instrument body and neck.

Another object of the present invention is to provide an inexpensive, simple means of biasing an instrument neck into a side bearing surface of the neck receiving cavity in the instrument body.

Yet another object of the present invention is to minimize the number of components needed for biasing a musical instrument neck into a side bearing surface in the body.

DETAILED DESCRIPTION OF THE INVENTION

Overview

Many stringed musical instruments, such as guitars, are comprised of a body and a neck. A neck proximal section has to be securely connected to a neck receiving cavity defined in the body such that the neck does not move relative to the body. The tension of the guitar strings creates a constant strain on the neck joint. The neck is long, so significant force can be applied to the neck joint by handling of the guitar. Any movement of the neck relative to the body is undesirable, as this makes the instrument feel flimsy. The movement also misaligns the strings along the neck, changes the tuning as the strings are flexed, and leads to premature failure of the joint between the body and the neck.

Screws or bolts provide a quick, inexpensive method for connecting the neck to the body. If screws are used to pull the neck proximal section into a bottom, flat major bearing surface of a neck receiving cavity, there is a chance for the neck to wiggle within the neck receiving cavity. This connection provides only one plane of bearing contact between the neck receiving cavity and the neck itself. The neck and the body are often made of wood or similar materials, which will compress slightly around the screws or in small areas. Due to this slight compression, the neck is able to twist and move. If the neck proximal end is securely pressed into a side surface as well as the major bearing surface, there are two separate, intersecting planes which support the position of the neck. By using two separate planes as bearing surfaces, the rigidity of the neck joint is increased substantially.

The Body and Neck Receiving Cavity

Figure 1:
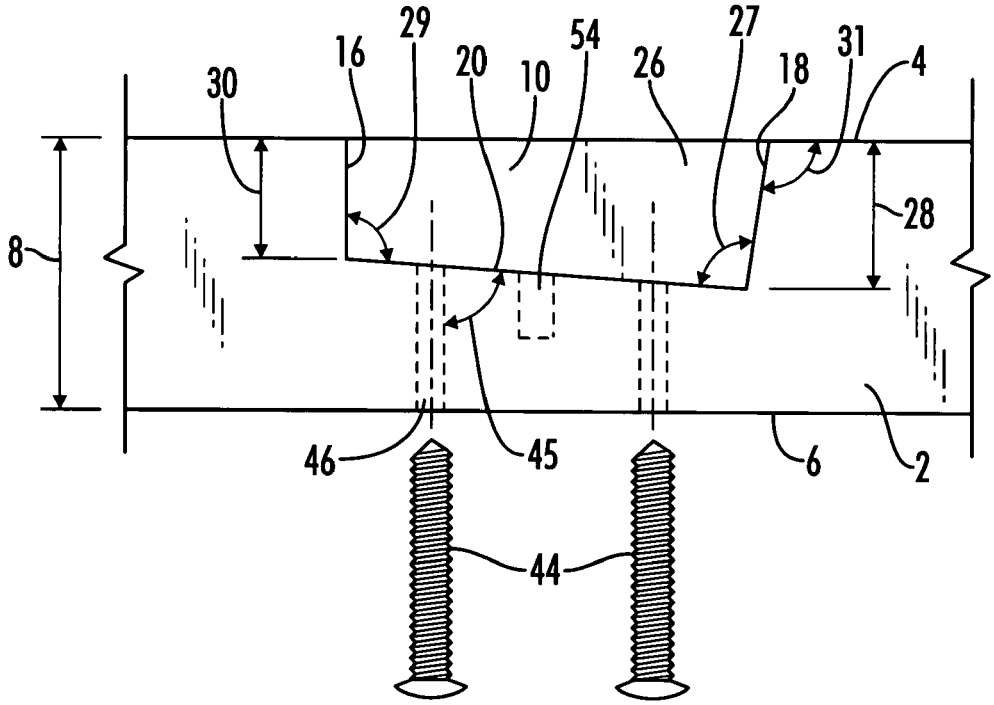
FIG. 1 is an end view of the neck receiving cavity with two external connectors.
Figure 4:
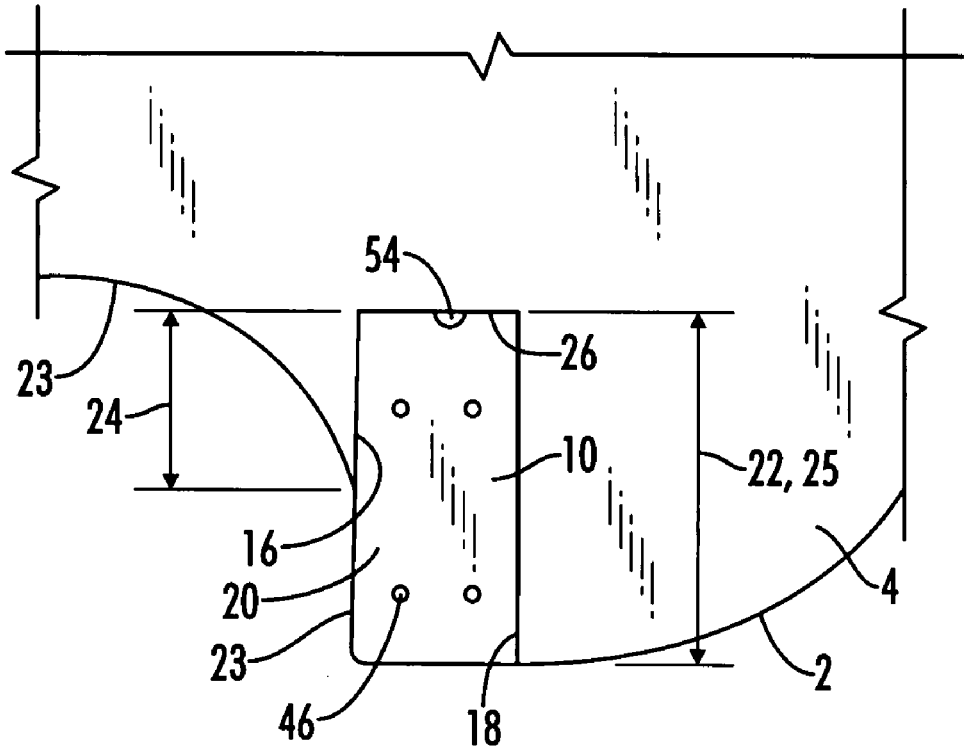
FIG. 4 is a top view of the guitar body and neck receiving cavity.

This invention relates to the joint between an elongated neck and body of a stringed musical instrument, preferably a guitar. As shown in FIGS. 1 and 4, the guitar body 2 has a front surface 4 and a back surface 6. The strings of the guitar would be positioned directly above the front surface 4. The body 2 also has a depth 8, which is defined as the distance from the front surface 4 to the back surface 6. The depth 8 is not necessarily constant across the entire guitar body 2. The guitar body 2 has a neck receiving cavity 10 in which a neck 12 is inserted. A proximal section 14 of the neck, also referred to as the neck joint section 14, is adapted to engage the neck receiving cavity 10 as better seen in FIGS. 2 and 5. In other words, the dimensions and geometry of the neck joint section 14 are formed to match the dimensions and geometry of the neck receiving cavity 10. In this disclosure, the tuner head is at the distal end of the guitar.

The neck receiving cavity 10 has four surfaces. A minor side surface 16, also called the cutout surface 16 or second side surface 16, generally intersects the body front surface 4 at about a right angle. A major side surface 18, also referred to as a first side surface 18, is opposite the cutout surface 16. A major bearing surface 20 is directly between the cutout surface 16 and the major side surface 18, so the major bearing surface 20 is flanked by the major side surface 18 and the cutout surface 16. The neck receiving cavity 10 also has an end surface 26 at the proximal end of the neck receiving cavity 10. The end surface 26 intersects the cutout surface 16, the major side surface 18 and the major bearing surface 20.

Referring now to FIGS. 1, 2, 4, & 5, the major side surface 18 and cutout surface 16 have lengths 22, 24 which are generally parallel to a length 25 of the major bearing surface 20. These lengths 22, 24 would also be parallel to the length of the guitar neck 12. In the preferred embodiment, the guitar body 2 has a cutout 23 formed in one side of the body 2 adjacent the neck receiving cavity 10. The cutout 23 allows the guitar player's fingers to reach the frets on the neck proximal end 14, which produce the higher notes. The length 22 of the major side surface 18 is greater than the length 24 of the cutout surface 16 due to the cutout 23 in the guitar body 2. In some guitar designs, the cutout surface length 24 is comparable to the major side surface length 22, but the guitar body 2 is very thin at the cutout surface 16. In these designs, the thinness of the body 2 prevents the cutout surface 16 from bearing significant stress.

In the preferred embodiment, the major bearing surface 20, the cutout surface 16, the major side surface 18, and the end surface 26 are all substantially flat or planar. The neck receiving cavity 10 is sloped, so if the guitar were lying flat on its back 6 and a ball were placed on the major bearing surface 20, gravity would cause the ball to roll towards the major side surface 18. Generally, the cutout surface 16 is approximately perpendicular to the guitar body front surface 4. The major bearing surface 18 intersects the guitar body front at an obtuse angle 31. To facilitate the formation of the neck receiving cavity 10, the major bearing surface 20 and the major side surface 18 intersect at approximately a right angle 27. The cutout surface 16 intersects the major bearing surface 20 at an obtuse angle 29, which is preferably between about 94° and about 98°.

The neck receiving cavity 10 has a depth defined as the distance from the guitar body front surface 4 to the major bearing surface 20. This neck receiving cavity depth 28 at the major side surface 18 is greater than the neck receiving cavity depth 30 at the cutout surface 16. The slope of the major bearing surface 20 causes this difference in the neck receiving cavity depths 28, 30. Preferably, the guitar body depth 8 is substantially equal at the major side surface 18 and the cutout surface 16. Therefore, the distance between the major bearing surface 20 and the back of the guitar body 4 is typically greater at the cutout surface 16 than at the major side surface 18. The guitar back 6 can be angled along the length of the neck and guitar, so the guitar depth 8 could vary along the major bearing surface length. The shape of the neck receiving cavity 10 is unaffected by the shape of the guitar back 6.

The neck receiving cavity depth 28 at the major side surface 18 is greater than the depth 30 at the cutout surface 16, and the length 22 of the major side surface 18 is greater than the length 24 of the cutout surface 16. Therefore the surface area of the major side surface 18 is greater than the surface area of the cutout surface 16. This larger area makes the major side surface 18 more suitable as a bearing surface than is the cutout surface 16.

The Neck

The neck joint section 14 comprises at least four surfaces such that the neck joint section 14 matches the neck receiving cavity 10. A rear bearing surface 32 is opposite a fret surface 34. The strings of the guitar would be over the fret surface 34. A first surface 36 is opposite a second surface 38, so the four surfaces 32, 34, 36, and 38 comprise the neck joint section 14. There is also a proximal surface 35, at the proximal end of the neck joint section 14. The proximal surface 35 intersects the fret surface 34, the first and second surfaces 36, 38, and the rear bearing surface 32. The rear bearing surface 32 of the neck joint section 14 faces the major bearing surface 20 of the neck receiving cavity 10 when the neck joint section 14 and the guitar body 2 are joined. Similarly, the first surface 36 faces the major side surface 18 and the second surface 38 faces the cutout surface 16. The proximal surface 35 faces the end surface 26.

The neck joint section 14 is adapted to engage, or to fit into, the neck receiving cavity 10. Therefore, the rear bearing surface 32 intersects the first surface 36 at a right angle 37, and the rear bearing surface 32 intersects the second surface 38 at an obtuse angle 39. The neck joint section 14 has a depth which is defined as the distance from the fret surface 34 to the rear bearing surface 32. A joint section depth 40 at the first surface 36 is greater than a joint section depth 42 at the second surface 38. This is necessary for the neck joint section 14 to tightly engage the neck receiving cavity 10.

The rear bearing surface 32 and the first and second side surfaces 36, 38 are substantially planar or flat where they contact the neck receiving cavity 10. Preferably, the neck joint section 14 extends above the guitar front surface 2. The first surface 36 is in contact with the major side surface 18, which intersects the body front 4 at an obtuse angle 31. The first surface 36 has a small angle at the point 43 where the first surface 36 extends beyond the guitar front 4. This first surface angle point 43 allows the neck first surface 36 to extend from the guitar body 2 at a right angle. The second surface 38, which is flat, extends from the guitar body 2 at a right angle, so there is no corresponding angle point on the second surface 38. Therefore, the first surface angle point 43 results in the guitar neck 12 extending from the guitar front 4 at right angles.

Connectors

Connectors 44 are used to connect the neck 12 to the guitar body 2. Preferably, elongated, threaded connectors 44 are used, such as screws or bolts. At least one connector 44 is needed, and preferably four connectors 44 are used. The connectors 44 are spaced to securely join the neck 12 and body 2. The connectors 44 are started in the guitar body back surface 6 and pass through the guitar body 2. The connectors 44 then pass through the major bearing surface 20 and into the neck joint section 14 through the rear bearing surface 32. Therefore the connectors 44 force or urge the rear bearing surface 32 into the major bearing surface 20.

The connectors 44 are preferably aligned substantially parallel to the cutout surface 18 and perpendicular to the fret surface 34. The connectors 44 do not pass through the fret surface 34, but they are aligned in a perpendicular orientation relative to the fret surface 34. The connectors 44 form an acute angle 45 with the major bearing surface 20, as measured from the connector 44 towards the major side surface 18. This acute angle is preferable between about 82° and 86°. Because the major bearing surface 20 is flat, the connectors 44 form an obtuse angle with the major bearing surface 20 as measured from the connector 44 towards the cutout surface. Therefore, the connectors 44 go essentially straight up from the guitar body back surface 6 into the neck joint section 14. A hole 46 can be provided in the guitar body 2, with a corresponding hole 48 in the neck joint section 14, for each connector 44. These holes 46, 48 serve as pilot holes for the connectors 44.

As the connectors 44 pull the rear bearing surface 32 into the sloped major bearing surface 20, the slope of the major bearing surface 20 combined with the joining force of the connectors 44 urge or bias the first surface 36 of the neck 12 laterally into the major side surface 18. Because the slope of the major bearing surface 20 and the corresponding slope of the rear bearing surface 32 laterally urge the neck 12 into the major side surface 18, it can be seen that the major side surface 18 and the first surface 36 serve as bearing surfaces. This provides two separate bearing surfaces defined in different planes to support the neck 12 in the neck receiving cavity 10. Glue could be added between the neck joint section 14 and the neck receiving cavity 10 if desired.

Figure 2:
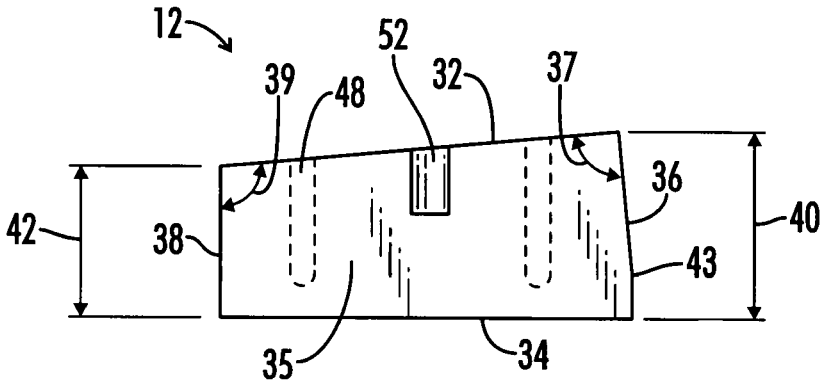
FIG. 2 is an end view of the proximal end of the neck.
Figure 3:
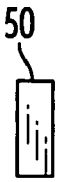
FIG. 3 is a front view of an alignment pin
Figure 5:
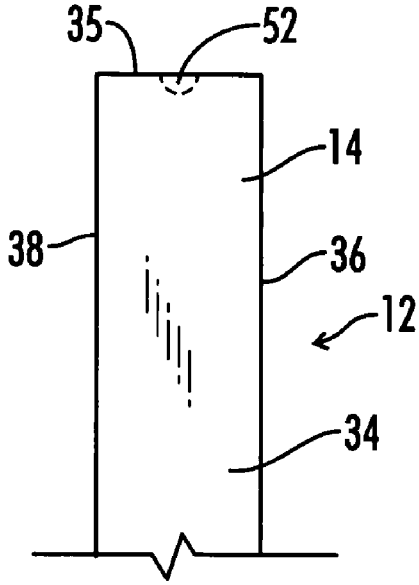
FIG. 5 is a top view of the neck.
Figure 6:
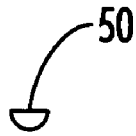
FIG. 6 is a top view of the alignment pin.

An alignment pin 50 is used to align the neck joint section 14 in the neck receiving cavity 10, as seen in FIGS. 3 and 6. The alignment pin 50 is received in an indentation 52 in the proximal surface 35 of the neck joint section 14, as seen in FIGS. 2 and 5. The alignment pin 50 is also received in a recess 54 in the major bearing surface 20, so the alignment pin 50 is received between the neck joint section 14 and the neck receiving cavity 10. Therefore, the alignment pin 50 serves to secure the neck 12 and the body 2 such that the recess 54 and the indentation 52 are aligned.

Method

The current invention also includes a method of creating a stringed musical instrument which is seen in FIGS. 1, 2, 4, and 5. The method includes providing an instrument or guitar body 2 and a neck 12 with the neck 12 having a proximal section 14. A neck receiving cavity 10 is created in the guitar body 2 wherein the neck receiving cavity 10 has a slope. The neck receiving cavity 10 also has a substantially flat major bearing surface 20 flanked by a first side surface 18 and a second side surface 16. A cavity depth is defined as the distance from a guitar body front surface 4 to the major bearing surface 20, and the slope results in the depth 28 at the first side surface 18 being greater than the depth 30 at the second side surface 16.

The proximal section 14 of the neck 12 is then inserted into the neck receiving cavity 10. At least one connector 44, and preferably four connectors 44, are inserted into the neck proximal section 14 through the guitar body 2 such that the connectors 44 pass through the major bearing surface 20. The connectors 44 are then tightened to pull the neck proximal section 14 into the major bearing surface 20. The slope of the major bearing surface 20 combined with the pulling force of the connectors 44 bias the neck proximal section 14 laterally into the first side surface 18.

Holes 46, 48 can be created in the guitar body 2 and the neck proximal section 14 to facilitate the insertion and alignment of the connectors 44. These holes 46, 48 serve as pilot holes 46, 48 for the connectors 44. The connectors 44 are then aligned substantially perpendicular to a fret surface 34 on the neck 12 and inserted through the guitar body 2 into the proximal section of the neck 14.

Thus, although there have been described particular embodiments of the present invention of a new and useful Musical Instrument Sloped Neck Joint, it is not intended that such references be construed as limitations upon the scope of this invention except as set forth in the following claims.

Thus, although there have been described particular embodiments of the present invention of a new and useful Musical Instrument Sloped Neck Joint, it is not intended that such references be construed as limitations upon the scope of this invention except as set forth in the following claims.

What is claimed is:

1. A stringed musical instrument comprising: a body having:

a front;

a back; and a neck receiving cavity defined at least in part by a sloped substantially planar major bearing surface flanked on opposite sides by a cutout surface and a major bearing side surface wherein the cavity has a cavity depth defined as a distance from the front of the body to the major bearing surface, the cavity depth being greater at the major bearing side surface than at the cutout surface; wherein the cutout surface and major bearing side surface intersect the sloped substantially planar major bearing surface at different angles;

an elongated neck having a joint section received in the neck receiving cavity, the joint section having a sloped substantially planar rear bearing surface opposite a fret surface, a first surface opposite a second surface, wherein the first surface faces the major bearing side surface, the sloped rear bearing surface faces the sloped major bearing surface, and the second surface faces the cutout surface; and at least one connector passing through the sloped major bearing surface such that the slope of the major bearing surface combined with the joining force of the connector biases the first surface laterally into the major bearing side surface.

2. The instrument of claim 1 wherein the sloped major bearing surface intersects the major bearing side surface at a right angle.

3. The instrument of claim 2 wherein the major bearing side surface intersects the body front at an angle between about 94 degrees and about 98 degrees.

4. The instrument of claim 1 wherein the connector is substantially perpendicular to the fret surface.

5. The instrument of claim 1 wherein the at least one connector comprises at least four elongated connectors, and all four connectors extend at an acute angle to the sloped major bearing surface.

6. The instrument of claim 1 wherein the body further comprises a guitar body.

7. The instrument of claim 1 wherein the cutout and major bearing side surfaces each have a length generally parallel to the sloped major bearing surface, and wherein the cutout surface length is less than the major bearing side surface length.

8. The instrument of claim 1 wherein the neck receiving cavity further comprises an end surface; wherein the end surface intersects the cutout surface, the major bearing side surface, and the sloped major bearing surface; and wherein the major bearing side surface, the end surface, and the cutout surface are substantially flat.

9. The instrument of claim 1 further comprising an alignment pin received between the neck joint section and the neck receiving cavity, wherein the neck joint section further comprises an indentation for receiving the alignment pin and the sloped major bearing surface includes a recess for receiving the alignment pin.

10. A stringed musical instrument comprising: a body having:

a front;

a back; and a neck receiving cavity defined at least in part by a sloped substantially planar major bearing surface flanked on opposite sides by a minor side surface and a major bearing side surface; wherein the minor side surface and major bearing side surface intersect the sloped substantially planar major bearing surface at different angles;

wherein the minor side surface and the major bearing side surface each have a length generally parallel to the sloped major bearing surface, the length of the minor side surface being less than the length of the major bearing side surface;

wherein the cavity has a cavity depth defined as a distance from the front of the body to the major bearing surface, the cavity depth being greater at the major bearing side surface than at the minor side surface;

an elongated neck having a joint section dimensioned to engage the neck receiving cavity, the joint section having a sloped substantially planar rear bearing surface opposite a fret surface, a first surface opposite a second surface, wherein the first surface faces the major bearing side surface, the sloped rear bearing surface faces the sloped major bearing surface, and the second surface faces the minor side surface; and at least one connector for connecting the neck and the body, wherein the connector passes through the sloped major bearing surface substantially perpendicular to the fret surface, so the connector pulls the sloped rear bearing surface towards the sloped major bearing surface and the first surface is urged laterally into the major bearing side surface.

11. The instrument of claim 10 wherein the sloped major bearing surface intersects the minor side surface at an obtuse angle and the sloped major bearing surface intersects the major bearing side surface at a right angle.

12. The instrument of claim 11 wherein the sloped major bearing surface intersects the minor side surface at an angle between about 94 degrees and about 98 degrees.

13. The instrument of claim 10 further comprising an alignment pin received between the neck joint section and the neck receiving cavity, wherein the sloped major bearing surface includes a recess for receiving the alignment pin.

14. The instrument of claim 13 wherein the neck joint section further comprises a proximal surface intersecting the sloped rear bearing surface, the fret surface, the first surface and the second surface, wherein the proximal surface includes an indentation and the alignment pin is received in the indentation.

15. The instrument of claim 10 wherein the at least one connector comprises at least four elongated connectors, and all four connectors extend at an acute angle to the sloped major bearing surface.

16. The instrument of claim 10 wherein the body further comprises a guitar body.

17. The instrument of claim 10 wherein the major bearing side surface and the minor side surface are substantially flat.

18. A method of creating a stringed musical instrument comprising:

(a) providing a body and a neck, the neck having a proximal section;

(b) creating a neck receiving cavity in the body, the neck receiving cavity having a sloped, substantially planar major bearing surface flanked by a first bearing side surface and a second side surface such that a cavity depth defined as the distance from a body front to the sloped major bearing surface is greater at the first side surface than at the second side surface; wherein the first side surface and second side surface intersect the sloped, substantially planar major bearing surface at different angles;

(c) inserting the proximal section of the neck into the neck receiving cavity;

(d) inserting at least one connector into the neck proximal section through the body such that the connector passes through the major bearing surface; and (e) tightening the connector to pull the neck proximal section into the sloped major bearing surface such that the sloped major bearing surface biases the neck proximal section laterally into the first side surface.

19. The method of claim 18 further comprising creating at least one hole in the body and the neck proximal section to facilitate the insertion and alignment of the connector.

20. The method of claim 18 wherein step (d) further comprises aligning the connector substantially perpendicular with a fret surface on the neck proximal section.

* * * * *